US007369105B2

(12) United States Patent
Moon

(10) Patent No.: US 7,369,105 B2
(45) Date of Patent: May 6, 2008

(54) SPACER DISCHARGING APPARATUS AND METHOD OF FIELD EMISSION DISPLAY

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 751 days.

(21) Appl. No.: 10/826,496

(22) Filed: Apr. 16, 2004

(65) Prior Publication Data

US 2005/0012692 A1 Jan. 20, 2005

(30) Foreign Application Priority Data

Apr. 18, 2003 (KR) ..... 10-2003-0024761

(51) Int. Cl.
*G09G 3/20* (2006.01)
*G09G 3/22* (2006.01)

(52) U.S. Cl. ..... 345/75.2; 315/169.3

(58) Field of Classification Search ..... 345/74.1, 345/75.2; 315/169.1, 169.3
See application file for complete search history.

(56) References Cited

U.S. PATENT DOCUMENTS 6,031,336 A * 2/2000 Rumbaugh et al. ..... 315/169.3
6,441,559 B1 * 8/2002 Yamamoto et al. ..... 315/169.1
2004/0207576 A1 * 10/2004 Moon ..... 345/75.2

* cited by examiner

*Primary Examiner*—Amr A. Awad
*Assistant Examiner*—Michael Pervan
(74) *Attorney, Agent, or Firm*—Lee, Hong, Degerman, Kang & Schmadeka

(57) ABSTRACT

A spacer discharging apparatus and method of a field emission display (FED) are disclosed. The spacer discharging apparatus of an FED includes a first resister connected between an anode electrode of the FED and a high voltage power source unit applying a high voltage to the anode electrode, and a switch unit connected to the anode electrode and the first resister and selectively connecting the anode electrode and the spacer ground electrode of the FED.

19 Claims, 6 Drawing Sheets

SPACER DISCHARGING APPARATUS AND METHOD OF FIELD EMISSION DISPLAY

BACKGROUND OF THE INVENTION

1. Field of the Invention

The present invention relates to a field emission display (FED) and more particularly, to a spacer discharging apparatus and method of a field emission display (FED).

2. Description of the Background Art

In general, as the information processing systems are developed and widely spread, a display device as a time information transmission means has increasing importance. Of display devices, researches are actively ongoing on a flat panel display such as a liquid crystal display (LCD), a plasma display panel (PDP) and the FED or the like, to accomplish a large screen, flatness, high luminance and high efficiency.

Especially, the FED, which is anticipated to be commercialized in the near future, receives much attention as a flat panel display for a next-generation information communications, which overcomes shortcomings of the flat display devices.

The FED includes a front substrate having a fluorescent material and an anode electrode and a back substrate having a gate electrode and a cathode electrode. In the FED, the distance between the front substrate and the back substrate is approximately 1~2 mm, short, so a high electric field is formed by a high voltage applied to the anode electrode. Accordingly, in the FED, electrons discharged by a difference between voltages applied to the gate electrode and the cathode electrode formed on the back substrate are drawn by the electric field formed by the high voltage-applied anode electrode, to excite the fluorescent material so as to be emitted.

The construction of the FED in accordance with the conventional art will now be described with reference to FIG. 1.

FIG. 1 is a sectional view showing the construction of the FED in accordance with the conventional art.

As shown in FIG. 1, the conventional FED includes a back substrate 110 having a cathode electrode 107, a dielectric layer 106 and a gate electrode 105 sequentially stacked on a lower glass substrate 108; and a front substrate 100 having an anode electrode 102 and a phosphor 103 sequentially stacked on an upper glass substrate 101.

A spacer 104 is positioned between the upper glass substrate 101 and the lower glass substrate 108 to maintain a certain distance therebetween. In addition, spacers 104 are distributively and evenly positioned on the entire surface of the front substrate 100 and the back substrate 110 so as to sufficiently tolerate a difference between an external atmospheric pressure and an atmospheric pressure according to high vacuum at the inner side thereof.

The conventional FED operates as follows.

First, when a certain voltage is applied to the gate electrode 105 and the cathode electrode 107, electrons are discharged from the cathode electrode 107 and the discharged electrons passes through the gate electrode 105 so as to be discharged by a quantum-mechanical tunneling effect. At this time, if the applied voltage is relatively high, the amount of electrons discharged from the cathode electrode 107 is increased, while if the applied voltage is relatively low, the amount of electrons discharged from the cathode electrode 107 is decreased.

Thereafter, the electrons discharged from the cathode electrode 107 are accelerated toward the anode electrode 102 with the phosphor 103 coated thereon by being influenced by the electric field formed by the high voltage applied to the anode electrode 102. Accordingly, electrons collide with the phosphor 103 to generate energy.

Electrons existing in the phosphor 103 are excited by the generated energy to emit visible light.

However, some of electrons discharged from the cathode electrode 107 are not accelerated toward the phosphor-coated anode electrode 102 but collide with the spacer 104 to electrostatically charge the surface of the spacer 104. Namely, the charged electrons can change distribution of a voltage around the spacer 104. In this case, since the change in the voltage distribution around the spacer 104 can distort flow of the discharged electrons, causing degradation of a display state such as appearance of noise on the screen and visible appearance of a position of the spacer 104 on the screen. In addition, the change in the voltage distribution around the spacer 104 can generate an electric arc between the spacer 104 and the cathode electrode 107.

FIG. 2 is a plan view showing the structure of the FED in accordance with the conventional art.

As shown in FIG. 2, the conventional FED includes a scan electrode 107A applying a scan voltage to the cathode electrode 107; a data electrode 105A applying a data voltage to the gate electrode 105; and a high voltage power source unit 200 applying a high voltage to the anode electrode 102.

The conventional FED constructed as described above operates as follows.

First, a high voltage is applied from the high voltage power source unit 200 to the anode electrode 102. And, a scan voltage is applied to the scan electrode. 107A and a data voltage is applied to the data electrode 105A.

The applied scan voltage and the data voltage are respectively applied in synchronization with each other to the scan electrode 107A and the data electrode 105A, so that pixels are selected and driven to display an image on a screen.

However, the conventional FED does not have a discharge path for discharging electric charge charged on the spacer 104, so a noise is generated with the image displayed on the screen for a certain time while the electric charge charged on the spacer 104 is being discharged. This will now be described with reference to FIG. 3.

FIG. 3 is a graph showing a change of a voltage applied to an anode electrode of the FED in accordance with the conventional art.

As shown in FIG. 3, the change of the voltage applied to the anode electrode of the conventional FED indicates that even after the high voltage applied to the anode electrode 102 is cut off or power applied to the scan electrode 107A is cut off, the voltage or the power is gradually reduced for a certain time, so that there is a high possibility that noise generated on the screen.

In order to solve such a problem, a spacer discharging apparatus of the conventional FED in which a ground electrode is formed at a lower end portion of the spacer 104 will now be described with reference to FIG. 4.

FIG. 4 is a plan view showing the spacer discharging apparatus of the FED in accordance with the conventional art.

As shown in FIG. 4, the spacer discharging apparatus of the conventional FED includes a spacer ground electrode 104A formed at a lower end portion of the spacer 104.

However, even though the spacer ground electrode 104A is formed at the lower end portion of the spacer 104 to discharge electric charge charged at the spacer 104, the electric charge is not quickly discharged from the spacer 104 and the spacer 104 is radiated for a certain time.

As mentioned above, the conventional FED has the following problems. That is, since the electrons discharged from the cathode electrode collide with and are accumulated in the spacer, noise is generated on the screen.

SUMMARY OF THE INVENTION

Therefore, an object of the present invention is to provide a spacer discharging apparatus and method of an FED (Field Emission Display) capable of preventing generation of noise on a screen by controlling a discharge path, which selectively connects an anode electrode and a spacer ground electrode of the FED.

To achieve these and other advantages and in accordance with the purpose of the present invention, as embodied and broadly described herein, there is provided a spacer discharging apparatus of an FED including: a first resister connected between an anode electrode of the FED and a high voltage power source unit applying a high voltage to the anode electrode; and a switch unit connected between the anode electrode and the first resister, and selectively connecting the anode electrode and a spacer ground electrode of the FED.

To achieve the above object, there is also provided a spacer discharging method of an FED including: a step in which when a voltage applied to a scan electrode is cut off or a voltage applied to an anode electrode is cut off, a value of the voltage of the anode electrode is measured and a control signal is outputted based upon the measured voltage value; and a step in which a switch connecting the anode electrode and a spacer ground electrode is on/off according to the control signal to discharge electric charge charged on a spacer.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A spacer discharging apparatus and method of an FED, which is capable of preventing generation of noise on a screen by controlling a discharge path connected between an anode electrode and a spacer ground electrode, in accordance with preferred embodiments will now be described with reference to FIGS. 5 to 10.

Figure 1:
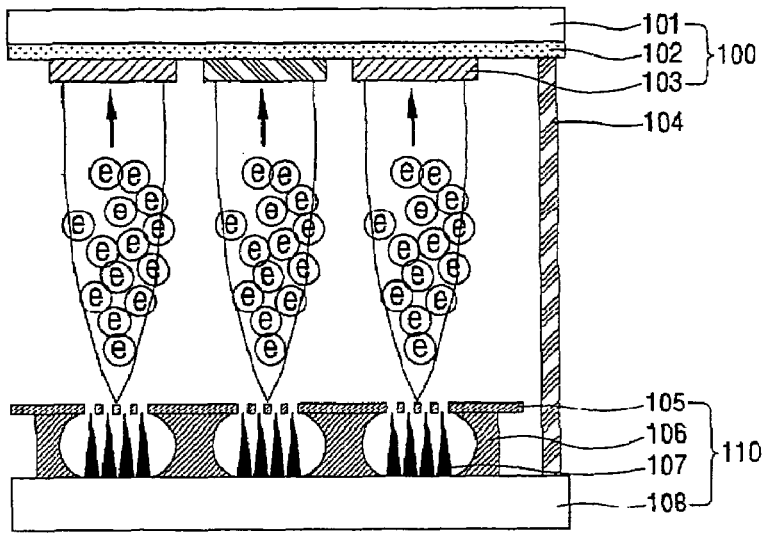
FIG. 1 CONVENTIONAL ART
FIG. 1 is a sectional view showing the structure of an FED (Field Emission Display) in accordance with a conventional art.
Figure 2:
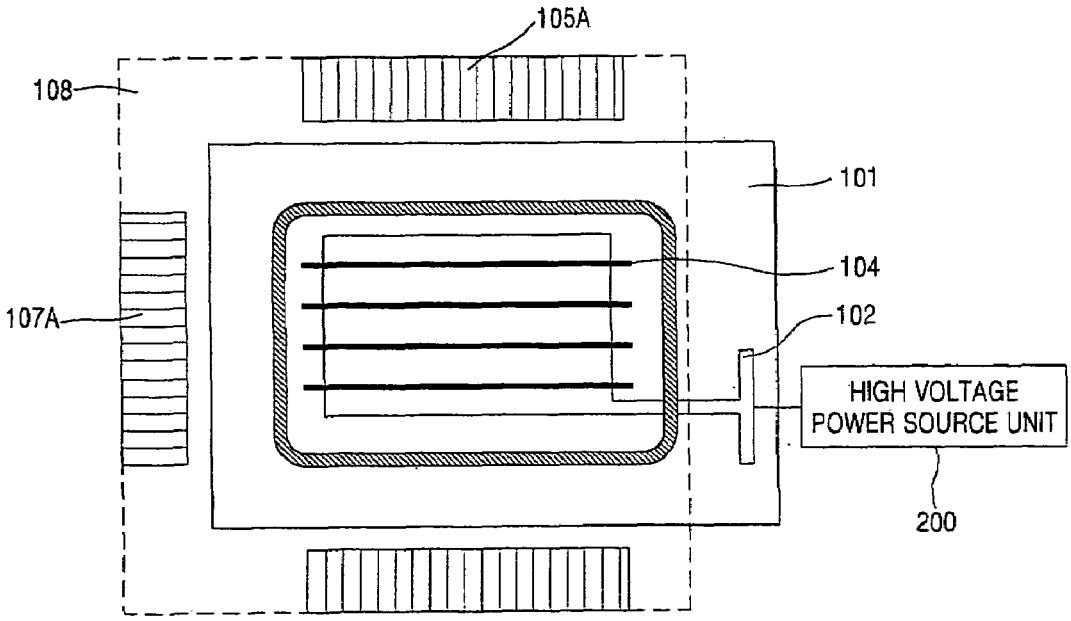
FIG. 2 CONVENTIONAL ART
FIG. 2 is a plan view showing the structure of the FED (Field Emission Display) in accordance with the conventional art.
Figure 3:
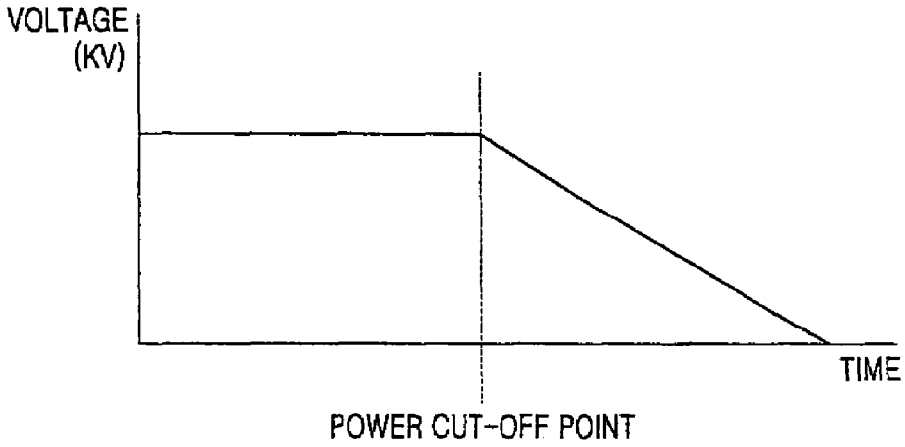
FIG. 3 CONVENTIONAL ART
FIG. 3 is a graph showing a change of voltage applied to an anode electrode of the FED in accordance with the conventional art.
Figure 4:
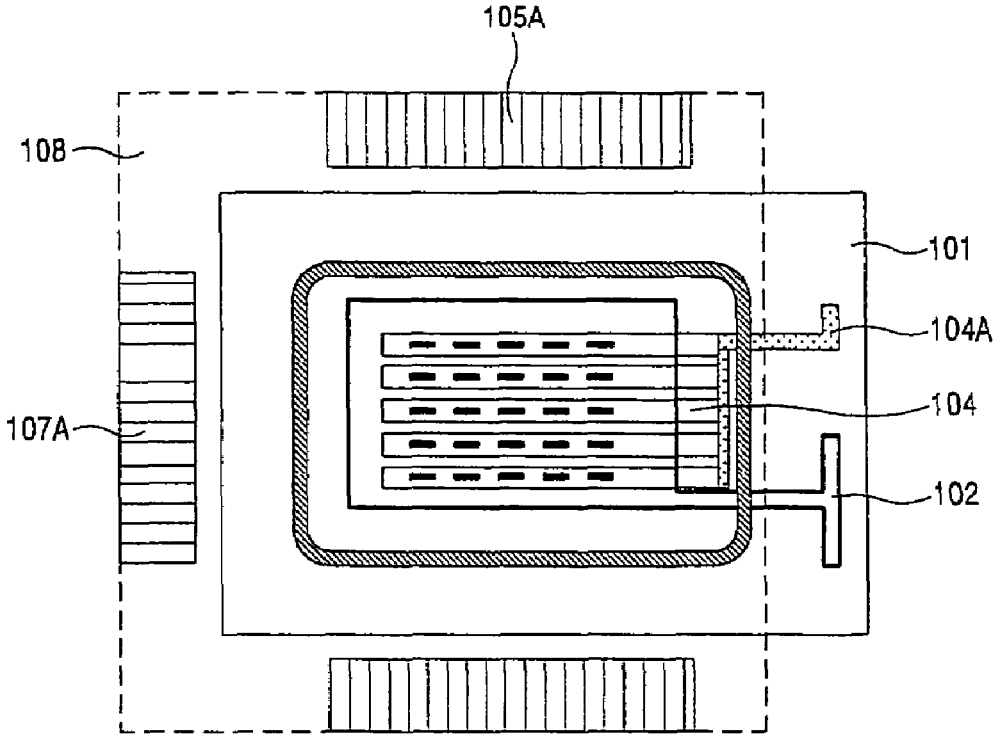
FIG. 4 CONVENTIONAL ART
FIG. 4 is a plan view showing a spacer discharging apparatus of the FED in accordance with the conventional art.
Figure 5:
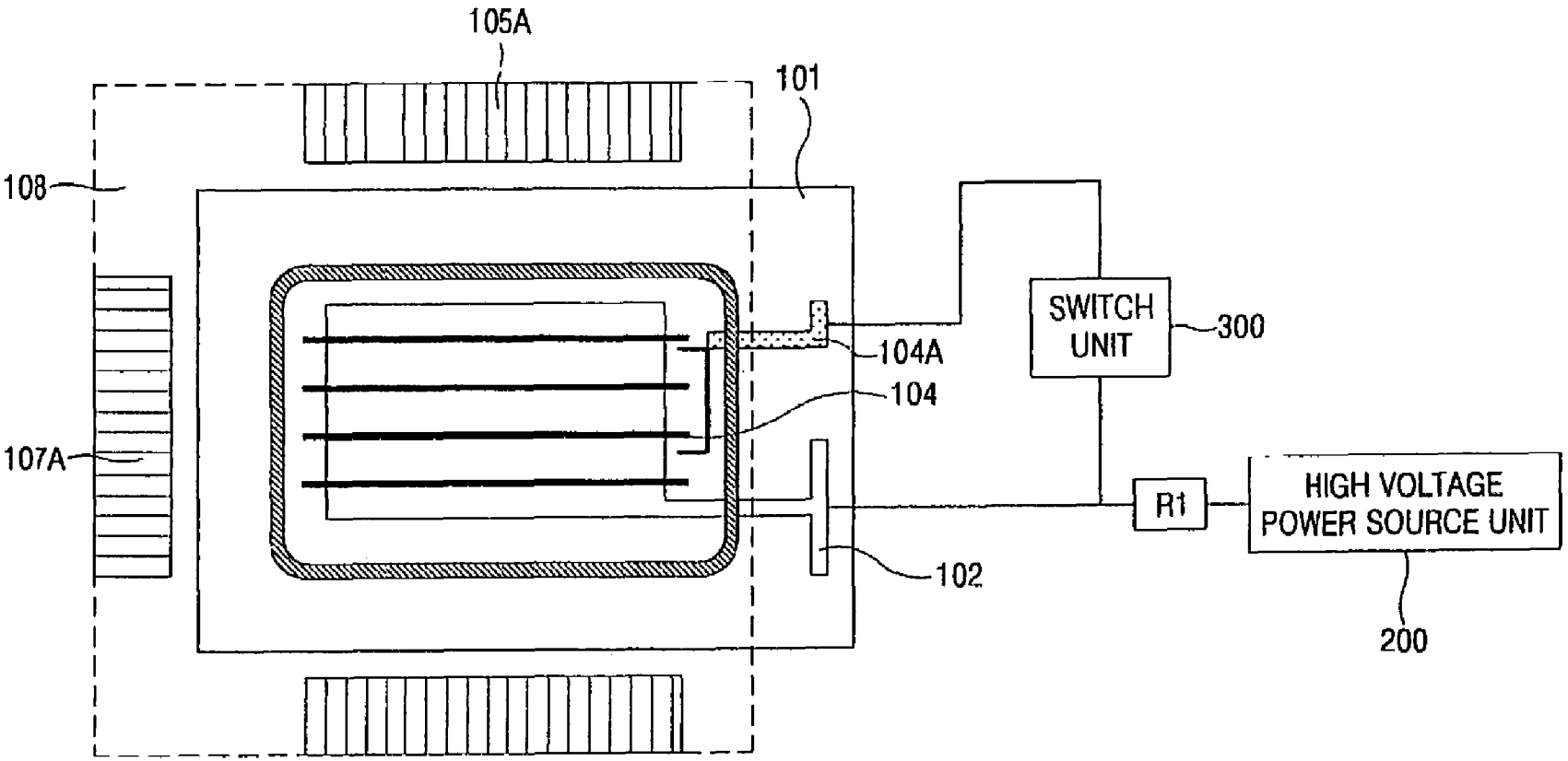
FIG. 5 is a plan view showing a spacer discharging apparatus of an FED in accordance with the present invention.

FIG. 5 is a plan view showing a spacer discharging apparatus of an FED in accordance with the present invention.

As shown in FIG. 5, a spacer discharging apparatus of an FED in accordance with the present invention includes a first resister R1 connected between an anode electrode 102 of the FED and a high voltage power source unit 200 applying a high voltage to the anode 102; and a switch unit 300 connected between the anode electrode 102 and the first resister R1 and selectively connecting the anode electrode 102 and a spacer ground electrode 104A.

In the spacer discharging apparatus of the FED, simply connecting of the spacer ground electrode 104A cannot quickly discharge electric charge from the spacer 104, so the switch unit 300 which connects the anode electrode 102 and the spacer ground electrode 104A of the FED is selectively connected to thereby quickly discharge the electric charge from the spacer 104.

However, when the anode electrode 102 and the spacer ground electrode 104A are short, electric charge charged on the spacer 104 can be reversely introduced into the high voltage power source unit 200 through the anode electrode 102 to impact on an internal element of the high voltage power source unit 200.

Thus, in order to prevent such discharging impact, the spacer discharging apparatus of the FED includes a first resister R1 with a sufficient size between the anode electrode 102 and the high voltage power source unit 200 in order to reduce an inrush current generated when the high voltage power source unit 200 supplies a high voltage to the anode electrode 102 and control a current generated when electric charge charged on the spacer 104 is introduced to the high voltage power source unit 200 to thereby protect the high voltage power source unit 200.

The spacer discharging apparatus of the FED in accordance with the first and second embodiments of the present invention will now be described.

Figure 6:
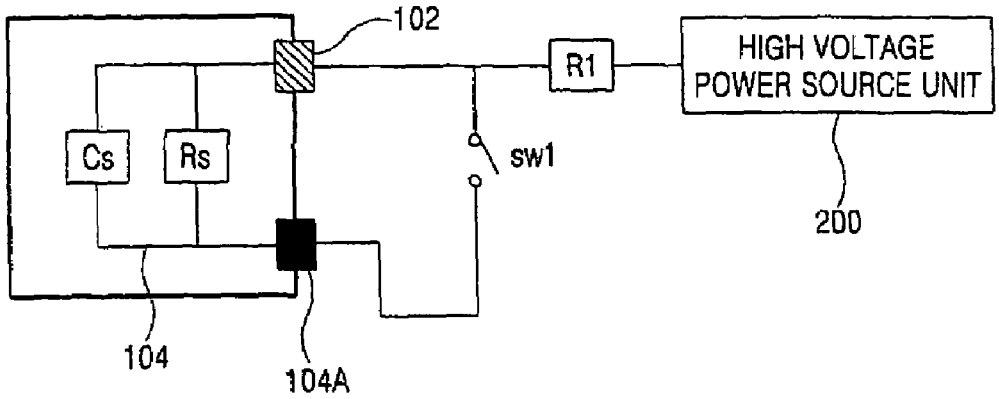
FIG. 6 is a schematic view showing a spacer discharging apparatus of an FED in accordance with a first embodiment of the present invention.

FIG. 6 is a schematic view showing a spacer discharging apparatus of an FED in accordance with a first embodiment of the present invention.

As shown in FIG. 6, the spacer discharging apparatus of the FED in accordance with the first embodiment of the present invention includes: a spacer 104 that can be represented as an equivalent circuit in which a resistance component (Rs) and a capacitance component (Cs) are connected in parallel; an anode electrode 102 connected to an upper end portion of the spacer 104; a spacer ground electrode 104A connected to a lower end portion of the spacer 104; a first resister R1 connected between the anode electrode 102 and the high voltage power source unit 200; and a switch SW1 connected to the resister R1 and selectively connecting the anode electrode 102 and the spacer ground electrode 104A.

In the spacer discharging apparatus of the FED in accordance with the first embodiment of the present invention, when a scan voltage applied to the scan electrode 107A or a high voltage applied to the anode electrode 102 is cut off, the anode electrode 102 and the spacer ground electrode 104A are short by the switch SW1, thereby quickly discharging electric charge from the spacer 104.

At this time, since an impact caused by the discharging is applied to the first resistor R1, a value of the first resister R1 must be sufficiently considered. Preferably, the first resister R1 has a resistance value of a few K~scores of M ohm.

Figure 7:
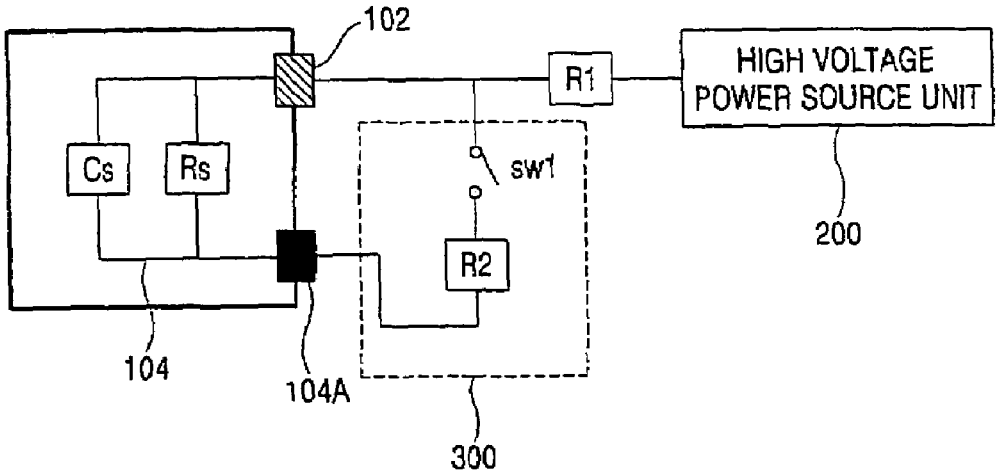
FIG. 7 is a schematic view showing a spacer discharging apparatus of an FED in accordance with a second embodiment of the present invention.

FIG. 7 is a schematic view showing a spacer discharging apparatus of an FED in accordance with a second embodiment of the present invention.

As shown in FIG. 7, a spacer discharging apparatus of an FED in accordance with the second embodiment of the present invention additionally includes a second resister R2 for controlling discharge time between the switch SW1 and the spacer ground electrode to the spacer discharging apparatus of the FED in accordance with the first embodiment of the present invention.

The second resister R2 is to be positioned between the anode electrode 102 and the spacer ground electrode 104A, so it can be positioned between the switch SW1 and the spacer ground electrode 104A or between the anode electrode 102 and the switch SW1.

In the spacer discharging apparatus of the FED in accordance with the second embodiment of the present invention, since the second resister R2 is positioned on the discharge path between the anode electrode 102 and the spacer ground electrode 104A, it can control discharge time to lower a high voltage applied to the anode electrode 102 or to below a predetermined voltage within a short time as a discharge resister for discharging electric charge charged on the spacer 104, and after the discharging is finished, even if the high voltage is continuously applied abnormally, the resister quickly discharges the voltage applied to the anode electrode 102 to below the predetermined voltage, so the anode electrode 102 can maintain the predetermined voltage. The predetermined voltage refers to a voltage at which light emitting does not occur from the spacer 104.

In addition, since the second resister R2 is positioned on the discharge path between the anode electrode 102 and the spacer ground electrode 104A, it can share the role of the first resister R1 which prevents the discharge impact applied to the high voltage power source unit 200, and because the voltage of the spacer 104 can be maintained at below the predetermined voltage, complete discharging is prevented and thus a power consumption can be reduced.

In brief, in the spacer discharging apparatus of the FED in accordance with the first and second embodiments of the present invention, if power applied to the scan electrode 107A or power applied to the anode electrode 102 is cut off, the switch unit 300 is driven, whereby noise on the screen caused by the electric charge charged on the spacer 104 can be prevented. A schematic structure of a controller for controlling the switch unit 300 will be described with reference to FIG. 8.

Figure 8:
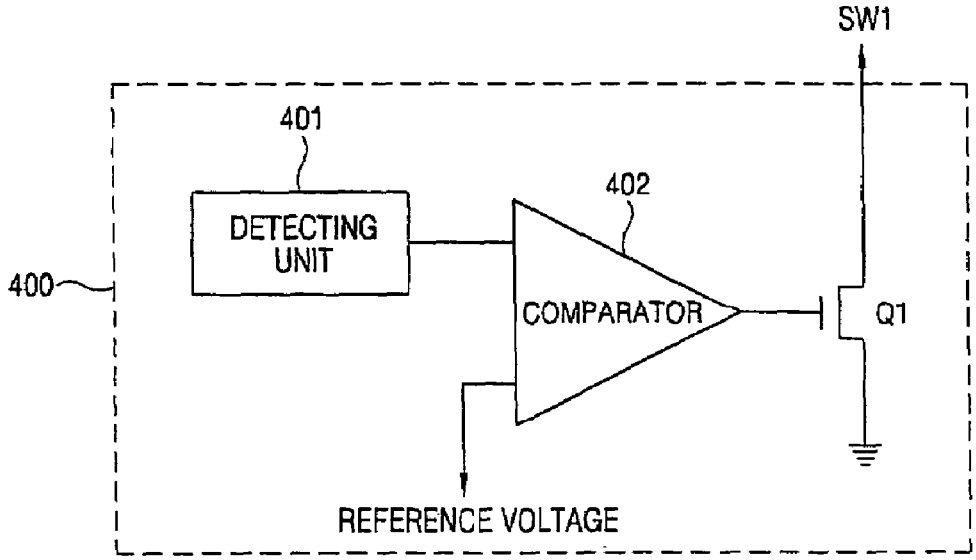
FIG. 8 is a schematic view showing a controller of the spacer discharging apparatus of an FED in accordance with the first embodiment of the present invention.

FIG. 8 is a schematic view showing a controller of the spacer discharging apparatus of an FED in accordance with the first embodiment of the present invention.

As shown in FIG. 8, a controller of the spacer discharging apparatus of the FED in accordance with the present invention includes: a detecting unit 401 for detecting a value of a voltage of the anode electrode 102 when the voltage applied to the scan electrode 107A or the anode electrode 102 is cut off; a comparator 402 for comparing the detected voltage value and a predetermined reference voltage value; and a transistor Q1 driven if the detected voltage value is greater than the predetermined voltage value.

The controller of the spacer discharging apparatus of the FED in accordance with the present invention will be described in detail as follows.

First, when the voltage applied to the scan electrode 107A and power applied to the anode electrode 102 are cut off, the detecting unit 401 detects a voltage value of the anode electrode 102 and outputs the detected voltage value to the comparator 402.

The comparator 402 compares the detected voltage value and a predetermined reference voltage, and if the detected voltage value is greater than the predetermined reference voltage, the comparator 402 outputs a control signal to drive the transistor Q1. Namely, when the FED is in a state of being driven with the voltages applied to the scan electrode 107A and to the anode electrode 102, since discharging is not required, the switch SW1 is not driven, and meanwhile, when the FED is in a stop state as voltages applied to the scan electrode 107A and the anode electrode 102 are cut off, the switch SW1 is driven for discharging, whereby the anode electrode 102 is maintained at at or below a certain voltage.

Thereafter, the transistor Q1 is driven on the basis of the outputted control signal and the switch SW1 is on/off on the basis of current flowing at the driven transistor Q1. Namely, when current flows at the transistor Q1, the switch SW1 is turned on, while no current flows at the transistor Q1, the switch SW1 is turned off. Preferably, the switch SW1 is implemented as an ON/OFF switching device such as a high voltage relay, a high voltage switch, thyrister or the like.

In this manner, in the spacer discharging apparatus of the FED in accordance with the present invention, since the anode electrode 102 and the spacer ground electrode 104A are short through the switch, electric charge charged on the spacer 104 can be quickly discharged. Namely, because the controller 400 discharges the electric charge charged on the spacer 104 after the driving of the FED is terminated, the controller 400 should be operated to provide a control signal only when the spacer 104 is abnormally radiated.

Results obtained from experimentation on a voltage change of the spacer discharging apparatus of the FED in accordance with the first and second embodiments of the present invention will now be described with reference to FIGS. 9 and 10.

Figure 9:
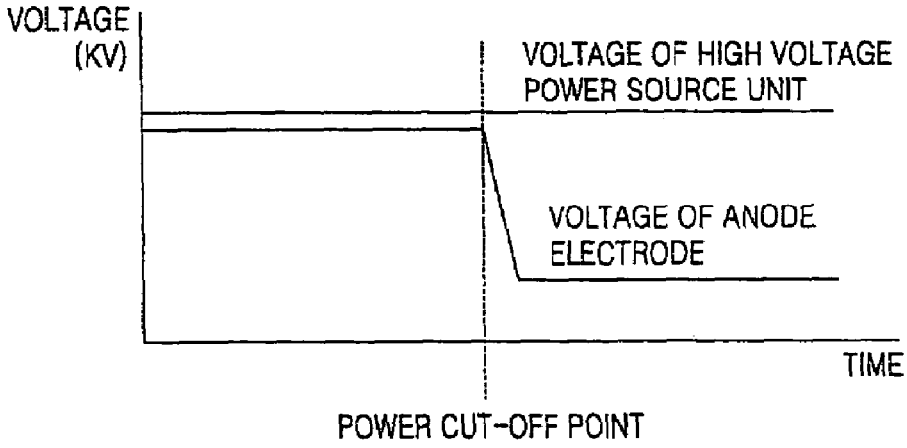
FIG. 9 is a graph showing a change of a voltage applied to an anode electrode of the FED adopting the first embodiment of the present invention.

FIG. 9 is a graph showing a change of a voltage applied to an anode electrode of the FED adopting the first embodiment of the present invention.

As shown in FIG. 9, as for a change of a voltage applied to the anode electrode of the FED adopting the first embodiment of the present invention, the voltage applied to the anode electrode is rapidly dropped as soon as it is cut off, so as to make a complete discharging.

Figure 10:
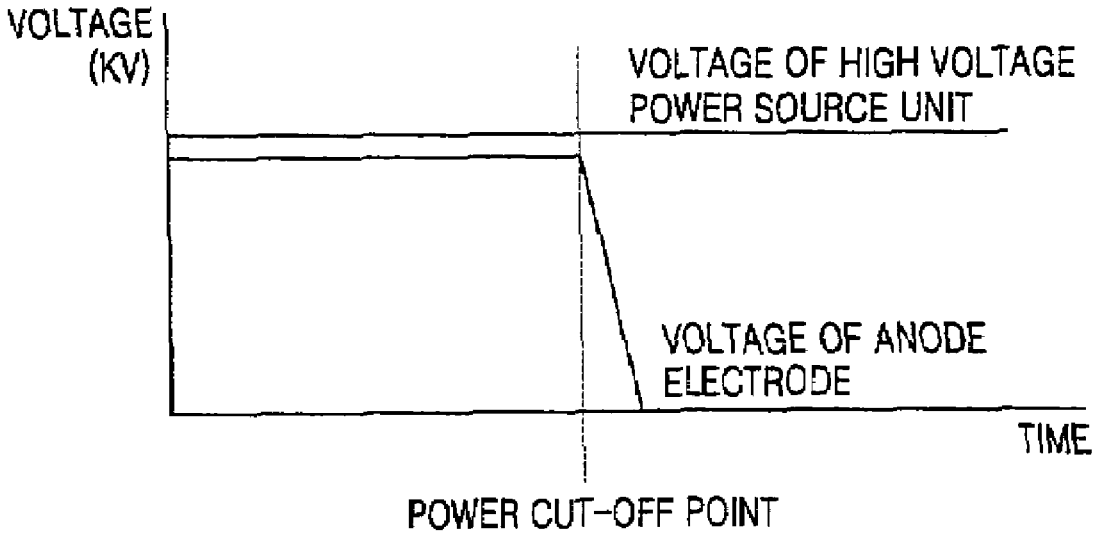
FIG. 10 is a graph showing a change of a voltage applied to an anode electrode of the FED adopting the second embodiment of the present invention.

FIG. 10 is a graph showing a change of a voltage applied to an anode electrode of the FED adopting the second embodiment of the present invention.

As shown in FIG. 10, as for a change of the voltage applied to the anode electrode of the FED adopting the second embodiment of the present invention, the voltage applied to the anode electrode 102 is rapidly dropped when it is cut off, but down to as low as the predetermined voltage due to the second resister R2.

Accordingly, in the spacer discharging apparatus of the FED in accordance with the first and second embodiments of the present invention, because the electric charge charged on the spacer 104 can be quickly discharged, an electric arc due to the high voltage or an abnormal radiation of the spacer can be prevented.

As so far described, the spacer discharging apparatus of the FED in accordance with the present invention has the following advantage.

That is, for example, electric charge charted on the spacer can be quickly discharged by controlling the discharge path connected between the anode electrode and the spacer ground electrode of the FED, generation of noise on the screen can be prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A spacer discharging apparatus of an FED (Field Emission Display) comprising:

a first resistor connected between an anode electrode of the FED and a high voltage power source unit applying a high voltage to the anode electrode; and a switch unit connected between the anode electrode and the first resistor, selectively connecting the anode electrode to a spacer ground electrode of the FED, wherein control of the switch unit is based on a value of a voltage applied to the anode electrode and a predetermined reference voltage value.

2. The apparatus of claim 1, wherein the switch unit is connected in series between the anode electrode and the spacer ground electrode and turned on and off.

3. The apparatus of claim 2, wherein the switch is one of a high voltage relay, a high voltage switch and a thyrister.

4. The apparatus of claim 2, further comprising:

a controller for turning the switch on and off.

5. The apparatus of claim 4, wherein the controller comprises:

a detector for detecting the value of the voltage of the anode electrode when the voltage applied to a scan electrode or the anode electrode of the FED is cut off;

a comparator for comparing the detected voltage value and the predetermined reference voltage value; and a transistor driven on the basis of the comparison result.

6. The apparatus of claim 5, wherein the switch is turned on when a current flows at the transistor, and the switch is turned off when no current flows at the transistor.

7. The apparatus of claim 1, wherein the switch unit comprises:

a switch connected in series between the anode electrode and the spacer ground electrode and turned on and off; and a second resistor connected in series between the switch and the spacer ground electrode.

8. The apparatus of claim 7, wherein the switch is one of a high voltage relay, a high voltage switch and a thyrister.

9. The apparatus of claim 7, further comprises:

a controller for turning the switch on and off.

10. The apparatus of claim 9, wherein the controller comprises:

a detector for detecting the value of the voltage of the anode electrode when the voltage applied to a scan electrode or the anode electrode of the FED is cut off;

a comparator for comparing the detected voltage value and the predetermined reference voltage value; and a transistor driven on the basis of the comparison result.

11. The apparatus of claim 10, wherein the switch is turned on when a current flows at the transistor, and the switch is turned off when no current flows at the transistor.

12. The apparatus of claim 7, wherein the second resistor is maintained at or below a predetermined voltage.

13. The apparatus of claim 12, wherein the predetermined voltage is a voltage at which the spacer is not radiated.

14. The apparatus of claim 12, wherein the second resistor is connected between the anode electrode and the switch.

15. The apparatus of claim 12, wherein the second resistor is connected between the switch and the spacer ground electrode.

16. A spacer discharging method of an FED (Field Emission Display), the method comprising:

detecting a value for the voltage of an anode electrode of the FED, when a voltage applied to a scan electrode of the FED is cut off or a voltaae applied to the anode electrode is cut off;

generating a control signal based upon the detected voltage value and a predetermined reference voltage value; and selectively connectin the anode electrode to a spacer round electrode according to the control signal to discharge an electric charge charged on a spacer of the FED.

17. The method of claim 16, wherein in discharging, the discharge time is controlled according to a resistance value of a resistor connected between a switch and the spacer ground electrode of the FED, wherein the switch is connected between the anode electrode and the spacer ground electrode.

18. The method of claim 17, wherein in discharging, the voltage applied to the anode electrode is maintained at or below a predetermined voltage according to the resistance value.

19. The method of claim 18, wherein the predetermined voltage is a voltage at which the spacer is not radiated.

* * * * *